US010695243B2

(12) United States Patent
Zhang

(10) Patent No.: US 10,695,243 B2
(45) Date of Patent: Jun. 30, 2020

(54) MULTI-FUNCTION MULTI-CONFIGURATION CARE BED FOR ENHANCED PATIENT COMFORT AND CAREGIVER CONVENIENCE

(71) Applicant: Jifeng Zhang, Houston, TX (US)

(72) Inventor: Jifeng Zhang, Houston, TX (US)

( * ) Notice: Subject to any disclaimer, the term of this patent is extended or adjusted under 35 U.S.C. 154(b) by 381 days.

(21) Appl. No.: 15/201,318

(22) Filed: Jul. 1, 2016

(65) Prior Publication Data

US 2018/0000671 A1 Jan. 4, 2018

(51) Int. Cl.

| | |
|---|---|
| ***A61G 7/02*** | (2006.01) |
| ***A61G 7/00*** | (2006.01) |
| ***A61G 7/018*** | (2006.01) |
| ***A61G 7/10*** | (2006.01) |

(52) U.S. Cl.

CPC ..... *A61G 7/0005* (2013.01); *A61G 7/018* (2013.01); *A61G 7/02* (2013.01); *A61G 7/1017* (2013.01); *A61G 7/1042* (2013.01)

(58) Field of Classification Search

CPC ..... A61G 7/02
USPC ..... 5/600, 606
See application file for complete search history.

(56) References Cited

U.S. PATENT DOCUMENTS

| | | | |
|---|---|---|---|
| 2,432,147 | A | 12/1947 | Freund |
| 3,477,069 | A | 11/1969 | Stiger |
| 3,503,063 | A | 3/1970 | Barnett |
| 3,965,501 | A | 6/1976 | Bucher |
| 4,023,218 | A | 5/1977 | Di Matteo |
| 4,085,472 | A | 4/1978 | DiMatteo |
| 4,112,524 | A | 9/1978 | Johansson |

(Continued)

FOREIGN PATENT DOCUMENTS

| | | |
|---|---|---|
| CN | 2036825 U | 5/1989 |
| CN | 2905017 Y | 5/2007 |

(Continued)

OTHER PUBLICATIONS

Website: https://www.youtube.com/watch?v=7smib_3Wa10 Downloaded Feb. 29, 2016 SmartCare Bed Imagine a hospital bed that changes its own sheets automatically, and is also a bath, shower, and toilet for bed-ridden patients without need to move them. This bed greatly reduces injuries to caregivers.

(Continued)

*Primary Examiner* — Fredrick C Conley
(74) *Attorney, Agent, or Firm* — Russ Weinzimmer & Associates, P.C.

(57) ABSTRACT

A multi-function care bed is disclosed including a flatbed having a plurality of panels foldable between a first configuration in which the plurality of panels are adapted to support a person in a horizontal position, and a second configuration in which the plurality of panels are adapted to form a chair to support the person in a seated position. The multi-function care bed also includes a bed frame configured to support the person on a mattress, the bed frame being movable between a first position in which the bed frame substantially overlies the flatbed, and a second position in which the plurality of panels of the flatbed are exposed so as to allow transfer of the person between the bed frame and the flatbed. The multi-function care bed also includes a body movement system in which a group of arms lift, lower, roll, or massage the person.

7 Claims, 5 Drawing Sheets

(56) References Cited

U.S. PATENT DOCUMENTS

| | | | | |
|---|---|---|---|---|
| 4,190,913 | A | 3/1980 | DiMatteo et al. | |
| 4,227,269 | A | 10/1980 | Johnston | |
| 4,631,762 | A | 12/1986 | Fugett | |
| 4,821,348 | A | 4/1989 | Pauna | |
| 4,989,280 | A | 2/1991 | Bair | |
| 5,054,136 | A | 10/1991 | Inagaki | |
| 5,101,519 | A | 4/1992 | Yamamoto | |
| 5,134,737 | A | 8/1992 | Wyman | |
| 5,341,820 | A | 8/1994 | Hammett | |
| 5,906,017 | A | 5/1999 | Ferrand et al. | |
| 6,009,570 | A | 1/2000 | Hargest et al. | |
| 6,289,536 | B1 | 9/2001 | Betson | |
| 6,948,201 | B2 | 9/2005 | Yoshimori | |
| 7,028,355 | B2 | 4/2006 | Koga | |
| 8,424,134 | B2 | 4/2013 | Byun | |
| 2010/0125951 | A1* | 5/2010 | Stefano | A61G 7/02 5/604 |
| 2010/0293707 | A1 | 11/2010 | Dean | |
| 2012/0255115 | A1 | 10/2012 | Akesson et al. | |
| 2014/0310875 | A1* | 10/2014 | Iida | A61G 1/01 5/606 |

FOREIGN PATENT DOCUMENTS

| | | | |
|---|---|---|---|
| CN | 201171520 | Y | 12/2008 |
| CN | 201445614 | U | 5/2010 |
| CN | 201831762 | U | 5/2011 |
| CN | 102688127 | A | 9/2012 |
| CN | 202409331 | U | 9/2012 |
| CN | 203663015 | U | 6/2014 |
| CN | 204133742 | U | 2/2015 |
| CN | 204446395 | U | 7/2015 |

OTHER PUBLICATIONS

Website: http://www.alibaba.com/product-detail/A-bed-with-bathtub_131007922.html Downloaded Feb. 29, 2016 A bed with bathtub—It is for the elderly or serious disabled to take a bath right from the bed they use without moving to the bathroom.

* cited by examiner

MULTI-FUNCTION MULTI-CONFIGURATION CARE BED FOR ENHANCED PATIENT COMFORT AND CAREGIVER CONVENIENCE

FIELD OF THE INVENTION

This invention relates generally to care beds, and more particularly to a multi-function care bed that can easily be used with bedridden people.

BACKGROUND

For bedridden people, toileting, showering, and avoiding bedsores are some of the most difficult tasks to accomplish independently. Solutions for these issues differ depending on the level of the physical impairment of the bedridden person. It is understandable that someone who loses almost all movement capability must get a nurse's help.

Care beds are known that have showering envelopes, water collectors, or hoses, in which the bedridden person can remain in bed to accomplish these activities. Although these known care beds provide help to the bedridden person and to the nurse caring for that person, such care beds are still inconvenient in practice.

In some care beds, the mattresses or beds have openings for patients to do toileting. This type of bed needs to be customized. In addition, bedding on top of the mattress often gets contaminated during the toileting process. With the opening and contamination, patients often feel uncomfortable compared to a normal sleeping environment.

In another known care bed system, a shower bath uses a mattress that is put into a tub. The mattress can move vertically to help the patient get into and out of the water.

Another type of shower bath tub is known which contains a toilet seat inside the tub. The water closet function is provided without increasing the space requirement relative to conventional shower-bathtubs, and feces cannot block the shower water discharge. However, transferring the patient to the bath tub in the above two cases is still significant work for the nursing staff.

In some other systems, showering/bathing envelopes are provided in which a person can be laid down while the caretaker washes the person's body. Issues with such a device include: 1) the person must be transferred to the bathing envelope; and 2) watching and contacting the cared person's body during the bathing process are necessary, which makes some people uncomfortable.

A three-section mattress or platform is included in other systems, in which the mattress or platform can turn into a chair for showering or using a toilet. Such mattresses or platforms, however, have a waterproof surface which is good for showering or toileting, but is not good for long-term sleeping as comfortably as on a common mattress or a bed with dry and soft bedding.

Bedsores are another issue for many bedridden patients. One way to reduce bedsores is to use a mattress that has one or both sides which can rise under mechanical or electrical drive, as seen on today's market, which rolls the patient to the left or right, but nursing help is also sometimes needed.

SUMMARY

The invention provides at least the following advantages: 1) A mattress is moveable so as to avoid contamination during toileting, which greatly increases the bedridden person's comfort level and satisfaction; 2) During showering, the bedridden person does not need the caregiver to hold the shower head or to massage the person's body, thereby avoiding possible embarrassment; 3) Getting the bedridden person to and from the showering site is facilitated for both the bedridden person and the caretaker; and 4) reduction of the tendency to acquire bedsores, even after a long-time staying in bed.

A general aspect of the invention is a multi-function care bed including: a flatbed having a plurality of panels foldable between a first configuration in which the plurality of panels are adapted to support a person in a horizontal position, and a second configuration in which the plurality of panels are adapted to form a chair to support the person in a seated position; and a bed frame configured to support the person on a mattress, the bed frame being movable between a first position in which the bed frame substantially overlies the flatbed, and a second position in which the plurality of panels of the flatbed are exposed to allow transfer of the person between the bed frame and the flatbed.

In some embodiments, the multi-function care bed further includes: a body movement system, wherein the body movement system is configured to execute one or more operations including facilitating transfer of the person between the bed frame and the flatbed, rolling the person, and massaging the person.

In some embodiments, the multi-function care bed further includes: a shield movable between a lower elevation and a higher elevation, wherein the shield forms an enclosure about the chair when the shield is at the higher elevation.

In some embodiments, the shield includes a plurality of sheets, and end portions of at least two of the plurality of sheets connect with one another as the shield is moved between the lower elevation and the higher elevation.

In some embodiments, the multi-function care bed further includes: a portable toilet configured below an opening in a seat of the chair.

In some embodiments, the multi-function care bed further includes: a shower system configured to shower the person while seated on the chair. In further embodiments, the multi-function care bed includes: a hot air blower system configured to dry the person while seated on the chair.

In some embodiments, the multi-function care bed further includes: a water collector configured to receive spent shower water from the chair.

Another general aspect of the invention is a multi-function care bed including: a bed frame configured to support a person on a mattress; a flatbed having a plurality of panels foldable between a first configuration in which the plurality of panels are adapted to support the person in a horizontal position, and a second configuration in which the plurality of panels form a chair adapted to support the person in a seated position; a panel control system configured to automatically drive the plurality of panels between the first configuration and the second configuration; a bed frame control system configured to automatically drive the bed frame between a first position in which the bed frame substantially overlies the flatbed, and a second position in which the plurality of panels of the flatbed are exposed to allow transfer of the person between the bed frame and the flatbed; and a body movement control system configured to execute one or more functions including automatically raising and lowering the person so as to facilitate transfer of the person between the bed frame and the flatbed, rolling the person, and massaging the person.

In some embodiments, the multi-function care bed further includes: an input control unit operable by the person to automatically control one or more of the panel control system, the bed frame control system, and the body movement system.

In some embodiments, the multi-function care bed further includes: a shield; and a shield control system configured to move the shield between a lower elevation and a higher elevation, the shield forming an enclosure about the chair when the shield is at the higher elevation.

In some embodiments, the multi-function care bed further includes: a portable toilet configured below an opening in a seat of the chair.

In some embodiments, the multi-function care bed further includes: a shower head disposed on a movable arm of an automatic movable arm control system, wherein the movable arm is automatically movable among a plurality of positions under control of the person.

In some embodiments, the multi-function care bed further includes: a hot air blower disposed on the movable arm, the hot air blower being movable by the automatic movable arm control system among a plurality of positions under control of the person.

In some embodiments, the multi-function care bed further includes: a shower head disposed on a movable arm of an automatic movable arm control system, the movable arm being automatically movable among a plurality of positions to shower the person while seated on the chair. In further embodiments, the multi-function care bed further includes: a hot air blower disposed on the movable arm, the hot air blower being movable by the automatic movable arm control system among a plurality of positions to dry the person.

Another general aspect of the invention is a multi-function care bed including: a flatbed having a plurality of panels foldable between a first configuration in which the panels are adapted to support a person in a horizontal position, and a second configuration in which the plurality of panels form a chair adapted to support the person in a seated position; a bed frame configured to support the person on a mattress, the bed frame being movable between a first position in which it substantially overlies the flatbed, and a second position in which the plurality of panels are exposed to allow transfer of the person between the bed frame and flatbed; a body movement system configured to execute one or more operations including raising and lowering the person to facilitate transfer of the person between the bed frame and the flatbed, rolling the person, and massaging the person; a shower system configured to shower the person while seated on the chair; a shield configured to form a shower enclosure about the person while the person is seated on the chair; and a water collector disposed below the chair and configured to receive spent shower water.

In some embodiments, the multi-function care bed further includes: a hot air blower system configured to dry the person while seated on the chair.

In some embodiments, the multi-function care bed further includes: at least one of: a panel control system configured to allow the person to automatically drive the plurality of panels between the first configuration and second configuration; a bed frame control system configured to allow the person to automatically drive the bed frame between the first position and the second position; and a body movement control system configured to allow the person to automatically drive the body movement system to raise and lower the person, to roll the person, and/or to massage the person.

In some embodiments, the multi-function care bed further includes: a portable toilet disposed below an opening in a seat of the chair.

BRIEF DESCRIPTION OF THE DRAWINGS

For a fuller understanding of the invention, reference is made to the following Detailed Description, taken in conjunction with the accompanying figures, in which.

DETAILED DESCRIPTION

Figure 1:
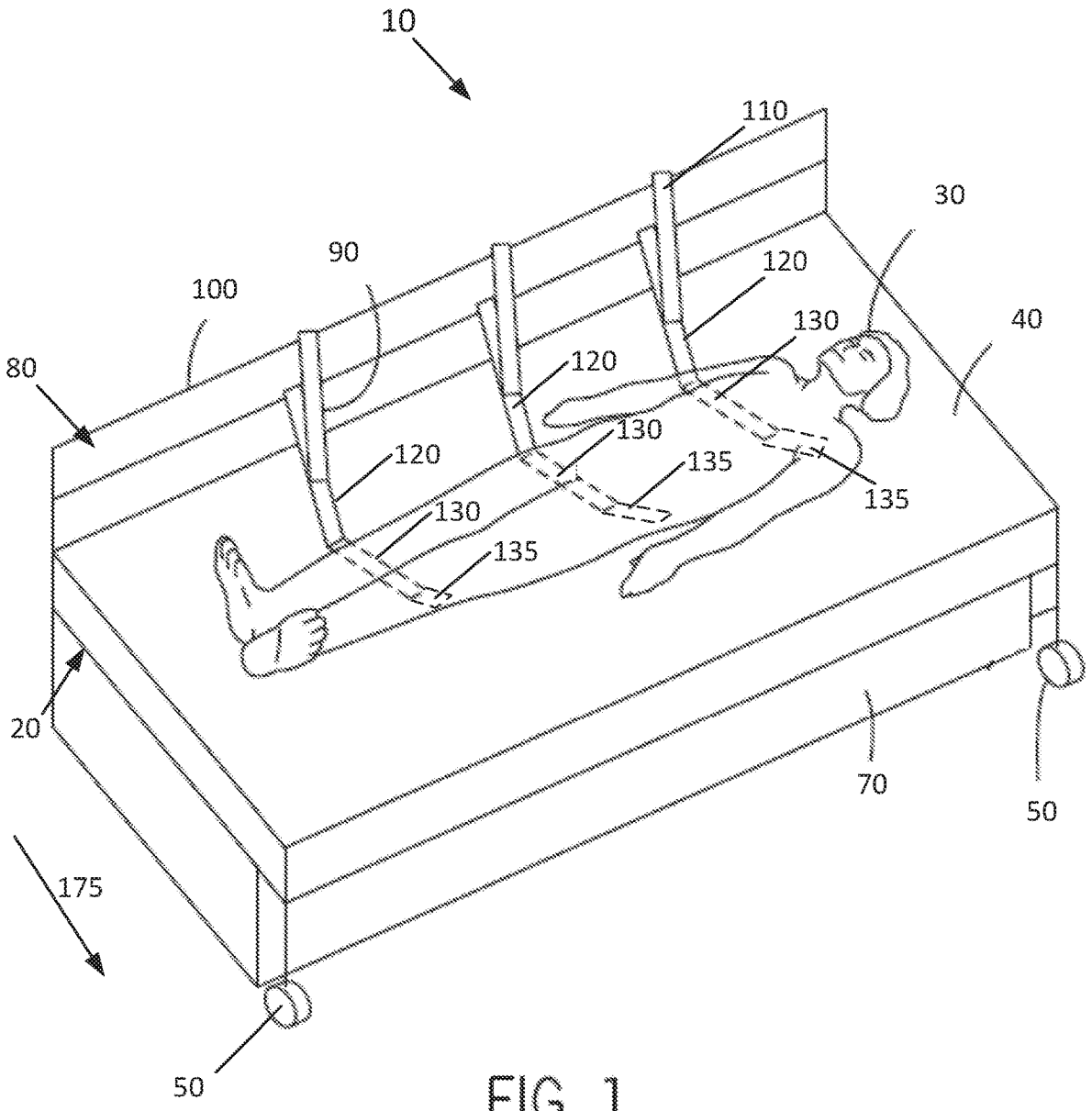
FIG. 1 is a perspective view of one embodiment of a multi-function care bed.

FIG. 1 is a perspective view of an embodiment of a multi-function care bed 10. In this example, the multi-function care bed 10 includes a bed frame 20 configured to support a person 30 on a mattress 40. A pair of wheels 50 are in fixed alignment with a first side of the bed frame 20 to facilitate movement of the bed frame 20 in the direction shown by arrow 175. The bed frame 20 is movable in the directions shown by arrow 175 between a first position in which the bed frame 20 substantially overlies a flatbed 70, and a second position in which a plurality of panels (not shown in FIG. 1) of the flatbed 70 are exposed to allow transfer of the person 30 between the mattress 40 of the bed frame 20 and the flatbed 70. Although wheels 50 are shown in FIG. 1 to facilitate relative movement between the bed frame 20 and the flatbed 70, other mechanisms can also be used.

A body movement system 80 is disposed near a second side of the bed frame 20, and can be secured in generally fixed alignment with the flatbed 70. Here, the body movement system 80 includes a plurality of arms 90. The arms 90 are supported by and movable along guide rails 100. Each arm 90 can be made of several segments. In this embodiment, each arm includes a first segment 110, a second segment 120 extending from the first segment 110, and a third segment 130 extending from the second segment 120, and a fourth segment 135 extending from the third segment 130. At least a portion of the upper surface of the arms 90 can be made of a soft and/or pliable material, such as a rubber material. In such instances, the arms 90 will not feel too hard or cold when contacting the person 30.

Figure 6:
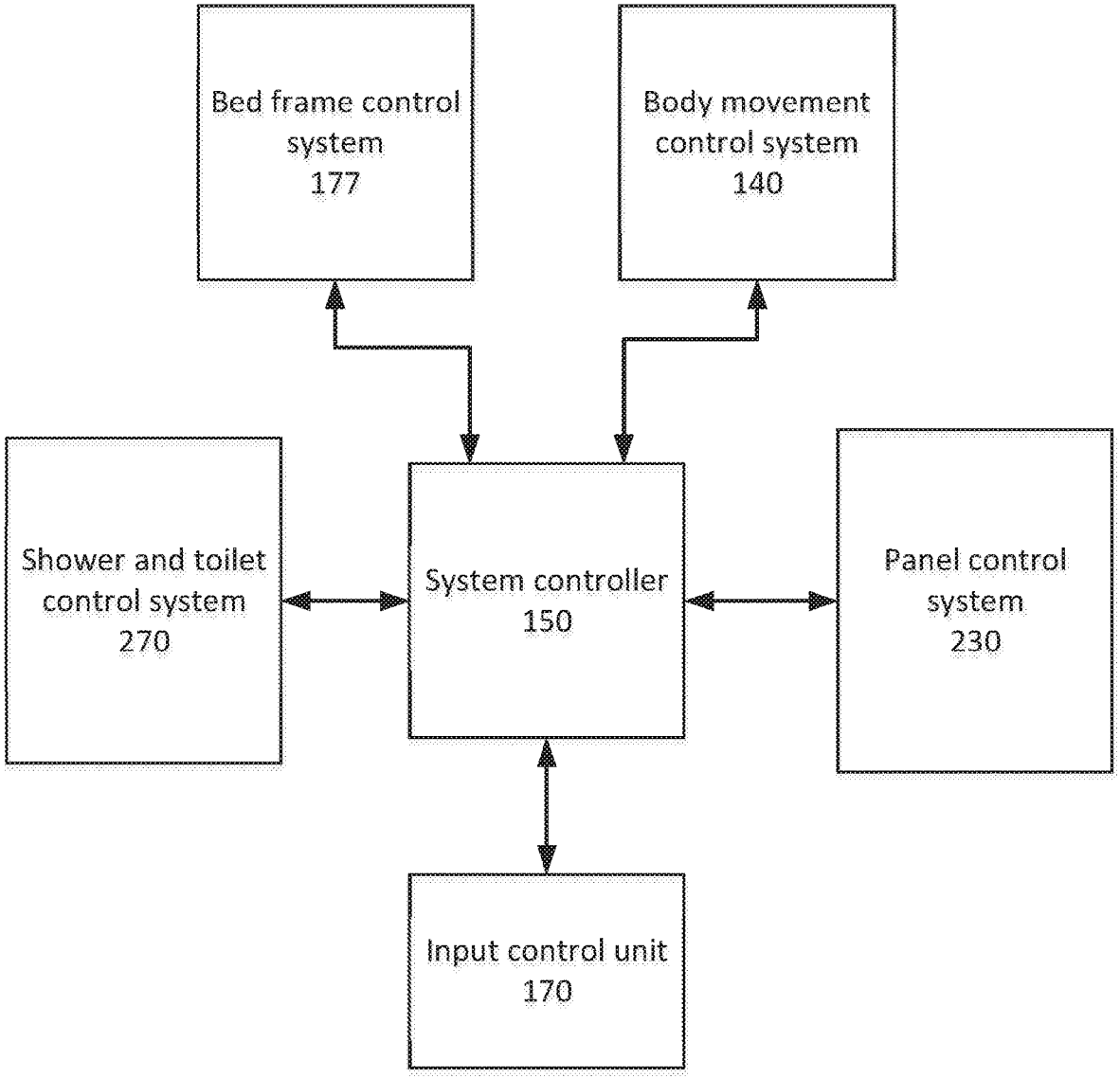
FIG. 6 is a block diagram of one embodiment of a control system that can control various elements of the multi-function care bed of FIG. 1.

Each segment 110, 120, 130 and 135 is configured to be driven by one or more electric motors of a body movement control system 140 (see FIG. 6) so as to move each arm 90 along several degrees of freedom. As shown in FIG. 6, the body movement control system 140 is configured for control by a system controller 150. The system controller 150 accepts input commands from the input control unit 170.

In FIG. 1, the bed frame 20 is shown in a position in which it substantially overlies the plurality of panels of the flatbed 70. In operation, the person 30 is lifted a short distance from the mattress 40 by the body movement system 80, and the bed frame 20 is moved in the direction shown by arrow 175 along guide rails 180 using, for example, the bed frame control system 177 in cooperation with the input control unit 170 and system controller 150 (see FIG. 6).

In FIG. 1, for rolling operation, the body movement system 90 raises the person's shoulder and hip from one side for a short distance, followed by a gentle push, to change the person from lying position to a lateral-recumbent position. Reversely, the body movement system 90 bends or pushes person's upper shoulder and hip so that the person 30 changes from a lateral-recumbent position to a lying down position. For massage operation, the fourth segment 135 of one or more arms 90 rub the patient's body gently, coordinated with segments 110, 120 and 130. The rolling and massage operations can all be under automatic control in a manner that matches the person's body physical dimensions. These operations reduce occurrences of bedsores.

Figure 2:
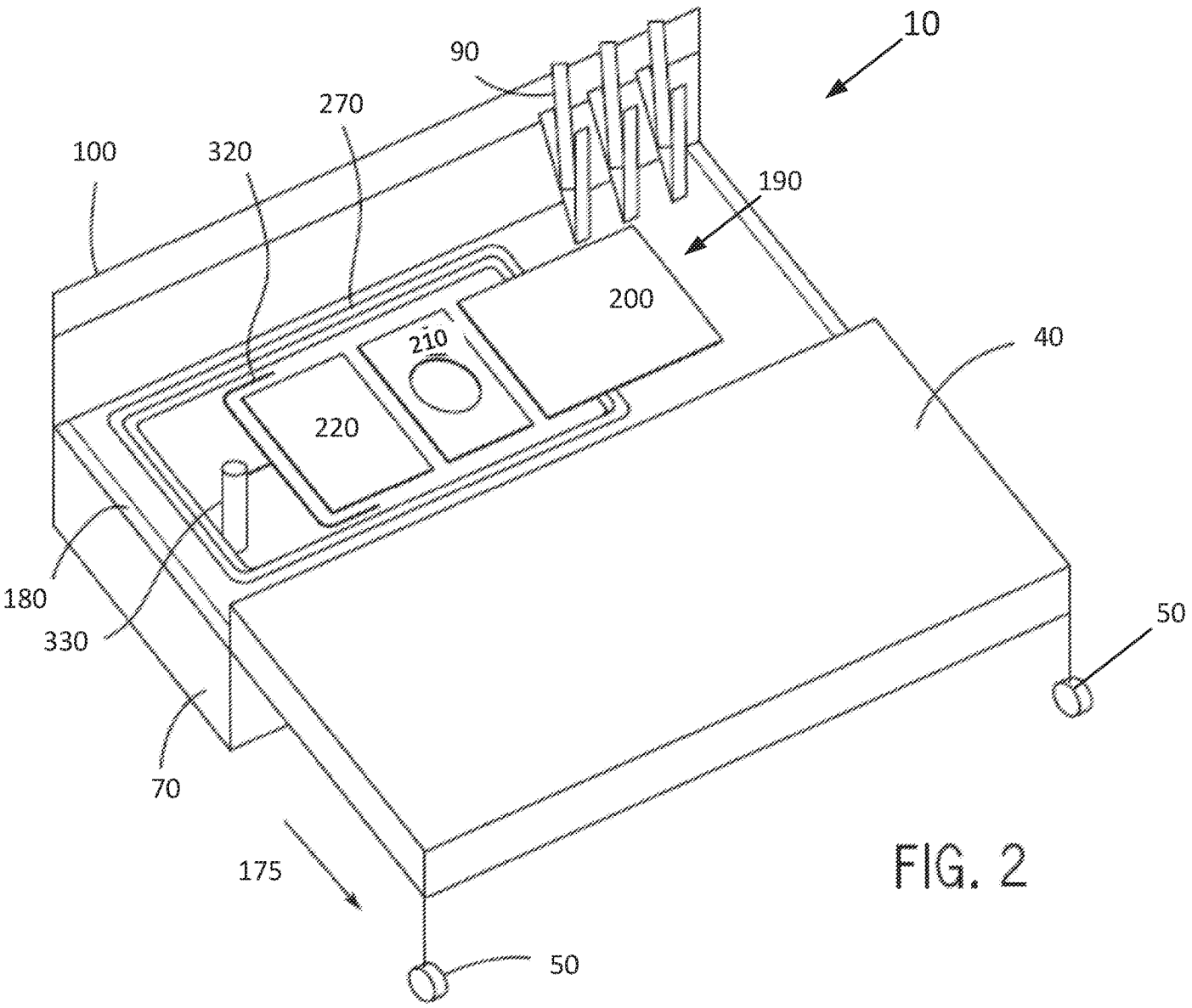
FIG. 2 is a perspective view showing the bed frame of the multi-function care bed of FIG. 1 moved to a position in which the person can be laid upon the plurality of panels of the flatbed.

With the mattress 40 and the bed frame 20 moved to the position shown in FIG. 2, the person 30 is laid upon the plurality of panels 190 of the flatbed 70 (person 30 not shown in FIG. 2). Here, the plurality of panels 190 includes a back support 200, a seat 210, and a leg panel 220. When the person 30 is laid upon the plurality of panels 190 by the body movement system 80, the panels 190 are aligned with one another in a generally horizontal manner. As such, the panels 190 initially support the person 30 in a lying down position. After the person has been transferred from the body movement system 80 to the plurality of panels 190, the arms 90 are retracted and moved along guide rails 100 to a parked position so as not to interfere with various subsequent toileting and showering operations of the multi-function care bed 10.

Figure 3:
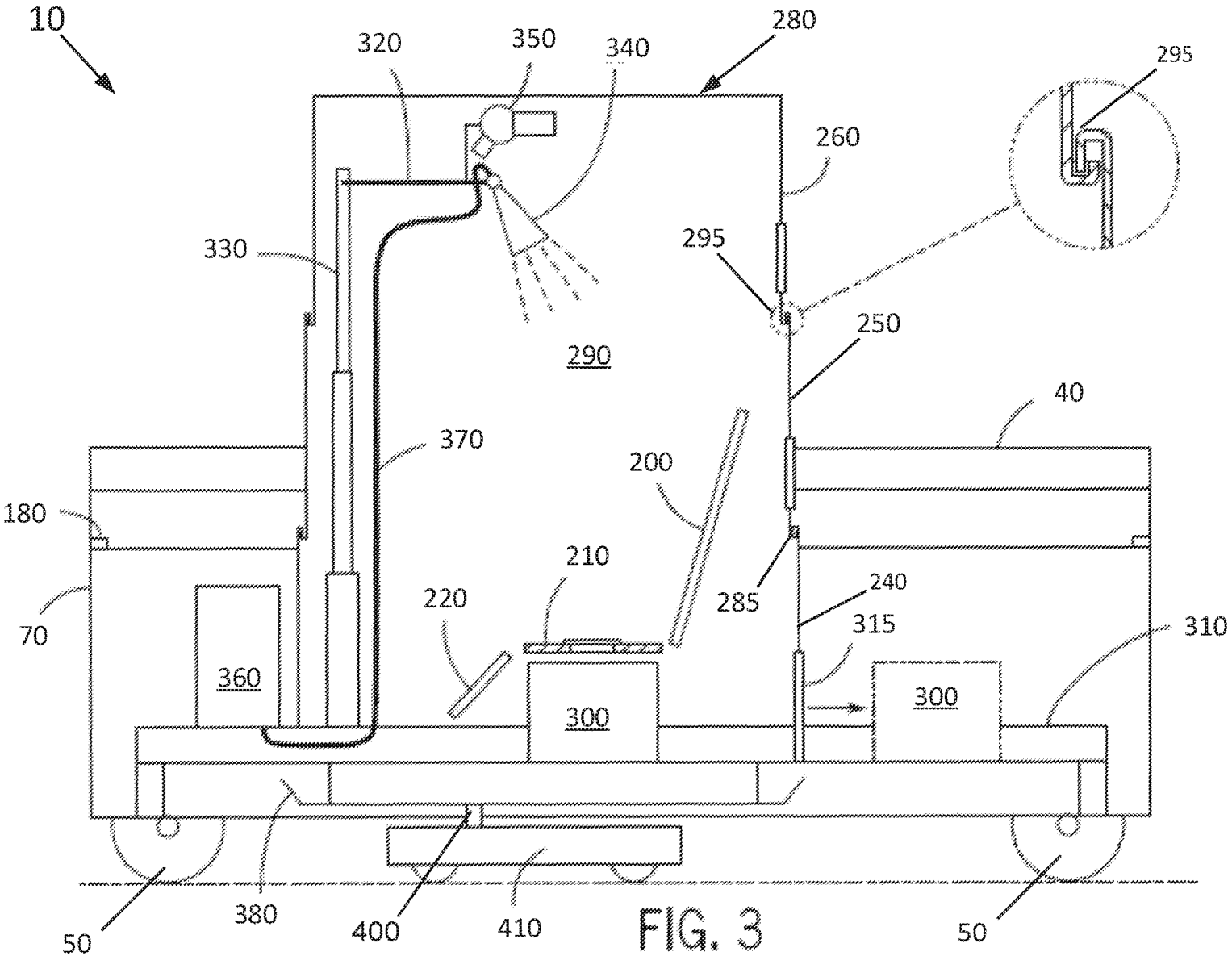
FIG. 3 is a partial, cross-sectional view showing the multi-function care bed of FIG. 1 in its working state.

FIG. 3 is a partial, cross-sectional view showing the multi-function care bed 10 in its working state. Before toileting or showering, the back support 200 is raised and the leg panel 220 is lowered using, for example, the panel control system 230. When the back support 200 and leg panel 220 are driven to the position shown in FIG. 3, they form a chair in which the person 30 is seated, and from which they can conduct showering and toileting. One or more of the back support 200, leg panel 220, and toileting seat 210 can be made of a hard material core having a soft waterproof covering so the person 30 can lay or sit comfortably.

In FIG. 3, a group of multi-layered sheets 240, 250, and 260 is raised using, for example, a shower and toilet control system 270 acting in cooperation with the system controller 150 and input control unit 170. In the illustrated embodiment, the sheets 240, 250, and 260 are concentric with one another so as to facilitate raising and lowering of the sheets. When raised, the multi-layered sheets 240, 250, and 260 define an enclosure shield 280 that can offer privacy to the person 30, and retain shower water within an enclosure 290. As the multi-layered sheets 240, 250, and 260 are raised, they engage one another at respective hook connections. Here, sheet 240 and sheet 250 are joined at hook connection 285. Similarly, sheet 250 and 260 are joined with one another at hook connection 295. Alternatively, each sheet can be raised separately.

For toileting, a detachable toilet 300 is moved from the position shown in dashed outline to a position underlying an opening of the seat 210. The detachable toilet 300 sits on a lower frame 310 of the flatbed 70 and is slidable along the lower frame 310 through an opening 315 at the rear of the enclosure 290.

Figure 5:
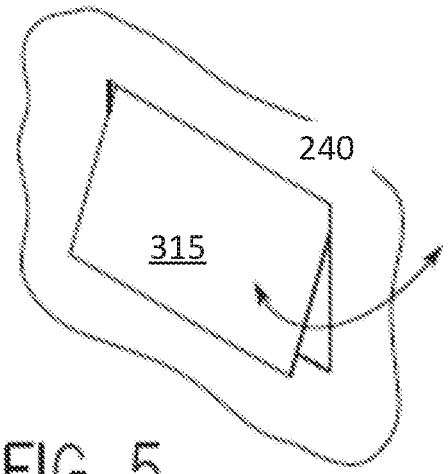
FIG. 5 is a perspective view of a hinged door that can be located at a rear portion of the enclosure shield.

As shown in FIG. 5, the opening in sheet 240 can be formed as a hinged mechanical door 315.

Once the person 30 has completed their toileting, the detachable toilet 300 is returned to the original position shown in dashed outline to remove waste. The detachable toilet may be driven using, for example, the shower and toilet control system 270 acting in cooperation with the system controller 150 and input control unit 170.

A base 320 is mounted on an extendable arm 330 formed from a plurality of concentric telescoping members. The base 320 can also be supported in other ways, such as on an articulating arm. The extendable arm 330 is used to hold a shower head 340 and a hot air blower 350 for showering. The base 320 of the illustrated embodiment is generally C-shaped and can move vertically with the extendable arm 330. The shower head 340 and the hot air blower 350 can move along the C-shaped base 320 to provide shower water from various directions to the person 30. The position of the shower head 340 and the hot air blower 350 along the C-shaped base 320, as well as the elevation of the extendable arm 330, can be controlled using, for example, the shower and toilet control system 270 working in cooperation with the system controller 150 and input received from the input control unit 170.

For showering, a water tank 360 supplies water through a hose 370 to the shower head 340. Shower water is confined within the enclosure 290 by the enclosure shield 280 and collected at the bottom of the enclosure 290 by a water collector 380, which is fixed to the lower frame 310. The water collector 380 has a discharge pipe 400 with valve. Water is discharged from the pipe 400 either directly to a sink, or to a water discharge container 410.

Figure 4:
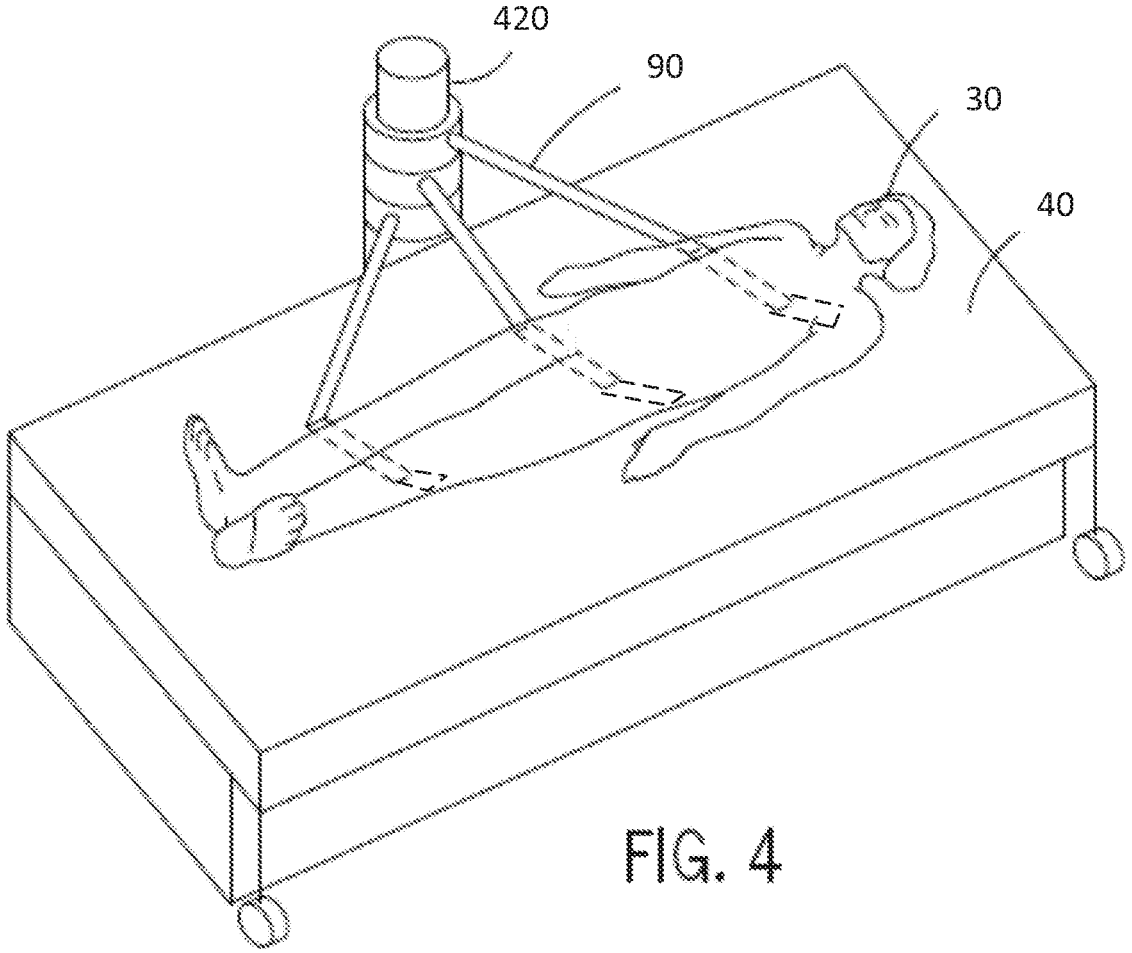
FIG. 4 is a perspective view of another embodiment of the multi-function care bed of FIG. 1.

FIG. 4 shows another embodiment of the multi-function care bed 10. In this embodiment, the arms 90 are rotatable about a pivot support 420, instead of moving linearly along the guide rails 180 shown in FIG. 1.

The operation of the multi-function care bed 10 has been described in the context of automatic control of various features using input received from the person 30 at an input control unit 170. To this end, the multi-function care bed 10 can include system components such as those shown in FIG. 6. For example, the system components of FIG. 6 can include one or more of: a panel control system 230 configured to automatically drive the plurality of panels between the first configuration and the second configuration; a bed frame control system 177 configured to automatically drive the bed frame between a first position in which the bed frame substantially overlies the flatbed, and a second position in which the plurality of panels of the flatbed are exposed to allow transfer of the person between the bed frame and the flatbed; a body movement control system 140 configured to automatically raise and lower the person to facilitate transfer of the person between the bed frame and the flatbed.

The system components may also include a shower and toilet control system 270 including one or more of: a shield control system configured to move the shield between a lower elevation and a higher elevation; a portable toilet control system; a movable arm control system, wherein the movable arm is automatically operable under control of the person to move the shower head and/or blower to the desired position. However, it will be recognized that one or more of the systems can be constructed for manual operation as opposed to automatic operation.

In the preceding specification, specific embodiments have been described. However, it is understood that various modifications and changes can be made without departing from the scope of the claims set forth below. Accordingly, the specification and figures are to be regarded in an illustrative rather than a restrictive sense, and all such modifications are intended to be included within the scope of the present teachings.

What is claimed is:

1. A multi-function care bed comprising:

a bed frame configured to support a person on a mattress;

a flatbed having a plurality of panels foldable between a first configuration in which the plurality of panels are adapted to support the person in a horizontal position, and a second configuration in which the plurality of panels form a chair adapted to support the person in a seated position;

a panel control system configured to automatically drive the plurality of panels between the first configuration and the second configuration;

a bed frame control system configured to automatically drive the bed frame between a first position in which the bed frame substantially overlies the flatbed, and a second position in which the plurality of panels of the flatbed are exposed to allow transfer of the person between the bed frame and the flatbed;

a body movement control system configured to execute one or more functions including automatically raising and lowering the person so as to facilitate transfer of the person between the bed frame and the flatbed, rolling the person, and massaging the person; and a shower head disposed on a movable arm of an automatic movable arm control system, wherein the movable arm is automatically movable among a plurality of positions under control of the person.

2. The multi-function care bed of claim 1, further comprising:

an input control unit operable by the person to automatically control one or more of the panel control system, the bed frame control system, and the body movement system.

3. The multi-function care bed of claim 1, further comprising:

a shield; and a shield control system configured to move the shield between a lower elevation and a higher elevation, the shield forming an enclosure about the chair when the shield is at the higher elevation.

4. The multi-function care bed of claim 1, further comprising:

a portable toilet configured below an opening in a seat of the chair.

5. The multi-function care bed of claim 1, further comprising:

a hot air blower disposed on the movable arm, the hot air blower being movable by the automatic movable arm control system among a plurality of positions under control of the person.

6. A multi-function care bed comprising:

a bed frame configured to support a person on a mattress;

a flatbed having a plurality of panels foldable between a first configuration in which the plurality of panels are adapted to support the person in a horizontal position, and a second configuration in which the plurality of panels form a chair adapted to support the person in a seated position;

a panel control system configured to automatically drive the plurality of panels between the first configuration and the second configuration;

a bed frame control system configured to automatically drive the bed frame between a first position in which the bed frame substantially overlies the flatbed, and a second position in which the plurality of panels of the flatbed are exposed to allow transfer of the person between the bed frame and the flatbed;

a body movement control system configured to execute one or more functions including automatically raising and lowering the person so as to facilitate transfer of the person between the bed frame and the flatbed, rolling the person, and massaging the person;

a shield;

a shield control system configured to move the shield between a lower elevation and a higher elevation, the shield forming an enclosure about the chair when the shield is at the higher elevation; and a shower head disposed on a movable arm of an automatic movable arm control system, the movable arm being automatically movable among a plurality of positions to shower the person while seated on the chair.

7. The multi-function care bed of claim 6, further comprising:

a hot air blower disposed on the movable arm, the hot air blower being movable by the automatic movable arm control system among a plurality of positions to dry the person.

* * * * *